US008098199B2

(12) United States Patent
Shinkai et al.

(10) Patent No.: US 8,098,199 B2
(45) Date of Patent: Jan. 17, 2012

(54) ARRAY ANTENNA APPARATUS INCLUDING MULTIPLE STEERABLE ANTENNAS AND CAPABLE OF AVOIDING AFFECTION AMONG STEERABLE ANTENNAS

(75) Inventors: Sotaro Shinkai, Osaka (JP); Wataru Noguchi, Hyogo (JP); Hiroyuki Yurugi, Osaka (JP); Masahiko Nagoshi, Osaka (JP); Akihiko Shiotsuki, Osaka (JP)

(73) Assignee: Panasonic Corporation, Osaka (JP)

( * ) Notice: Subject to any disclaimer, the term of this patent is extended or adjusted under 35 U.S.C. 154(b) by 114 days.

(21) Appl. No.: 12/738,700

(22) PCT Filed: Oct. 15, 2008

(86) PCT No.: PCT/JP2008/002914

§ 371 (c)(1),
(2), (4) Date: Apr. 19, 2010

(87) PCT Pub. No.: WO2009/050883

PCT Pub. Date: Apr. 23, 2009

(65) Prior Publication Data

US 2010/0231453 A1 Sep. 16, 2010

(30) Foreign Application Priority Data

Oct. 19, 2007 (JP) ..... 2007-272537

(51) Int. Cl.
*H01Q 3/02* (2006.01)
*H01Q 19/22* (2006.01)
*H01Q 19/24* (2006.01)

(52) U.S. Cl. ..... 342/374; 343/833; 343/834

(58) Field of Classification Search ..... 342/374; 343/833, 834
See application file for complete search history.

(56) References Cited

U.S. PATENT DOCUMENTS

| | | | | |
|---|---|---|---|---|
| 6,049,310 | A | 4/2000 | Sadahiro | |
| 7,477,198 | B2 * | 1/2009 | Kanazawa et al. | 343/702 |
| 7,489,948 | B2 * | 2/2009 | Taromaru et al. | 455/562.1 |

FOREIGN PATENT DOCUMENTS

| | | |
|---|---|---|
| JP | 55-33372 | 3/1980 |
| JP | 55-56703 | 4/1980 |
| JP | 2002-261532 | 9/2002 |
| JP | 2004-128557 | 4/2004 |
| WO | 98/42041 | 9/1998 |

OTHER PUBLICATIONS

International Search Report issued Jan. 20, 2009 in International (PCT) Application No. PCT/JP2008/002914.
International Preliminary Report on Patentability issued May 20, 2010 in International (PCT) Application No. PCT/JP2008/002914.

* cited by examiner

*Primary Examiner* — Gregory C Issing
(74) *Attorney, Agent, or Firm* — Wenderoth, Lind & Ponack, L.L.P.

(57) ABSTRACT

A steerable antenna includes an radiating antenna element and parasitic antenna elements. Each of the parasitic antenna elements is provided with a pair of PIN diodes. On each of control lines connecting the PIN diodes to a controller, inductors are provided at predetermined intervals on portions of the control line electromagnetically coupled to another steerable antenna. The intervals for providing the inductors is set to such a length that substantially no resonance occurs in a section of the control line between the inductors at an operating frequency of the steerable antenna.

5 Claims, 9 Drawing Sheets

ARRAY ANTENNA APPARATUS INCLUDING MULTIPLE STEERABLE ANTENNAS AND CAPABLE OF AVOIDING AFFECTION AMONG STEERABLE ANTENNAS

TECHNICAL FIELD

The present invention relates to a steerable array antenna apparatus capable of electrically steering its beam directions. More particularly, the present invention relates to a circuitry for controlling directivity of the array antenna apparatus.

BACKGROUND ART

In recent years, devices applying wireless techniques, such as wireless LANs complying with IEEE 802.11a/b/g standards, and Bluetooth, have been rapidly spreading. IEEE 802.11a and IEEE 802.11g specified the data transmission rate of 54 Mbps, and recently, active researches and developments have been done on wireless schemes for achieving higher transmission rates.

As one of techniques for increasing transmission rates of wireless communication systems, a MIMO (Multi-Input Multi-Output) communication system has received wide attention. This is a technique for increasing transmission capacity and improving communication speed by providing both the transmitter and the receiver with multiple antenna elements and having transmission paths spatially multiplexed. This technique is essential not only for wireless LANs, but also for next-generation wireless communication systems such as mobile phone communication systems and IEEE 802.16e (WiMAX).

In the MIMO communication scheme, a transmitter divides and sends transmitting data through multiple antenna elements, the data is transmitted over multiple virtual MIMO channels, and a receiver receives signals through multiple antenna elements and processes the signals to obtain received data. Generally, a wireless device using the MIMO communication scheme is provided with multiple omnidirectional antenna elements such as dipole antennas or sleeve antennas. In this case, there is a problem of degradation in transmission quality caused by increases in the correlations between antenna elements, unless addressing this situation by, e.g., sufficiently separating the antenna elements from one another, or tilting the respective antenna elements in different directions to make a combination of different polarizations.

As a conventional technique available for solving the above problem, for example, there is an array antenna apparatus of Patent Literature 1, which is an adaptive directional antenna. The array antenna apparatus of Patent Literature 1 includes three printed wiring boards arranged so as to surround a half-wave dipole antenna mounted vertically on a dielectric supporting substrate. The half-wave dipole antenna is supplied with a radio frequency signal through a balanced feeder cable. Moreover, on the back side of each printed wiring board, two sets of parasitic elements are provided in parallel with each other, each set including two printed antenna elements (elements each made of a conductor pattern). In each parasitic element, the two printed antenna elements oppose to each other with a space therebetween. A through-hole conductor is provided at one end of each printed antenna element opposing to the other printed antenna element, and is connected to an electrode terminal on the front side of the printed wiring board. In each parasitic element, a variable-capacitance diode is mounted between the two electrode terminals, and these electrode terminals are further connected to a pair of cables through high value resistors for blocking high frequencies, and the pair of cables are connected to bias voltage supply terminals DC+ and DC− of a controller (not shown) for controlling the directivity of the array antenna apparatus. By changing bias voltages supplied from the controller, the respective reactance values of the variable-capacitance diodes connected to the parasitic elements change. In this manner, the electrical length of each parasitic element is changed as compared to that of the half-wave dipole antenna, thus changing the horizontal directivity of the array antenna apparatus.

It is possible to reduce distances between antennas by using, as MIMO communication antennas, adaptive directional antennas such as the array antenna apparatus of Patent Literature 1, and setting the respective antennas' directivities so as to avoid correlations between the antennas.

Furthermore, by using adaptive directional antennas for MIMO communication, two advantages can be expected as follows. As a first advantage, in the case of a low electric field level at the receiver side, it is possible to direct a beam in a direction of arrival of a strong radio wave, thus receiving at a stable electric field level. As a second advantage, when fading occurs due to reflected waves from a wall or ceiling, one antenna receives a direct wave and the other antennas receive the reflected waves with long delay time, thus achieving more effective MIMO wireless communication.

CITATION LIST

Patent Literature

PATENT LITERATURE 1: Japanese Patent Laid-open Publication No. 2002-261532.

SUMMARY OF INVENTION

Technical Problem

By using the adaptive directional antennas of Patent Literature 1 in a MIMO communication system, it is possible to enjoy the above-mentioned three benefits, i.e., a reduction in the correlations between antennas, an improvement in communication quality, and an improvement in received power, and also possible to reduce an area occupied by an antenna apparatus.

However, in the case that the conventional adaptive directional antennas are arranged in close to each other, there is a problem that one of DC voltage supply lines connected to variable-capacitance diodes for controlling parasitic elements affects the directivity of an adjacent antenna, and thus, a desired directivity steering characteristic cannot be expected.

Moreover, the conventional adaptive directional antennas use variable-capacitance diodes with variable reactance, as switching elements for changing directivities. However, in a variable reactance element such as a variable-capacitance diode, there is a problem that its reactance value does not change with respect to the voltage in a centimeter-wave range of several GHz to several tens of GHz, and thus, the directivity can not change.

An object of the present invention is therefore to solve the above-described two problems of the prior art, and provide an array antenna apparatus that is capable of changing between "radiation in an omnidirectional pattern" and "radiation with a beam in a specific direction" even when reducing the distances between antennas or when operating in a centimeter-wave range of several GHz to several tens of GHz, and thus that is suitable for a MIMO communication scheme.

Solution To Problem

According to an aspect of the present invention, an array antenna apparatus including a plurality of steerable antennas is provided. Each of the plurality of steerable antennas is provided with: an radiating antenna element, at least one parasitic antenna element, at least one pair of rectifier elements provided to the at least one parasitic antenna element, control lines, at least two first inductors. The parasitic antenna element is located at a side of the radiating antenna element so as to be separated from the radiating antenna element in a direction by a distance, and the parasitic antenna element includes a first conductor portion and a second conductor portion. The pair of rectifier elements are provided between the first conductor portion and the second conductor portion, anodes of the rectifier elements are connected to each other, a cathode of a first one of the rectifier elements is connected to the first conductor portion, a cathode of a second one of the rectifier elements is connected to the second conductor portion, and the pair of rectifier elements operate the parasitic antenna element as a reflector when a bias voltage is applied thereto from bias voltage supply means. The control lines connect the rectifier elements to the bias voltage supply means. The at least two first inductors are provided on each of the control lines at predetermined intervals, at portions of the control line being electromagnetically coupled to a steerable antenna other than the steerable antenna including the rectifier elements to which the control line is connected. The intervals for providing the at least two first inductors is set to such a length that substantially no resonance occurs in a section of the control line between the first inductors at an operating frequency of the steerable antenna.

In the array antenna apparatus, the intervals for providing the at least two first inductors are set to a length such that the section of the control line between the first inductors is different from an integral multiple of one-quarter of an operating wavelength of the steerable antenna.

Moreover, in the array antenna apparatus, on each of the control lines, at least one second inductor is further provided at a portion of the control line electromagnetically coupled to the steerable antenna including the rectifier elements to which the control line is connected. A section of the control line between the rectifier elements and the second inductor is set to such a length that substantially no resonance occurs at an operating frequency of the steerable antenna.

Further, in the array antenna apparatus, the array antenna apparatus is patterned on a printed wiring board. Each of the plurality of steerable antennas includes two parasitic antenna elements such that the radiating antenna element is positioned between the parasitic antenna elements.

Furthermore, in the array antenna apparatus, the array antenna apparatus is patterned on a plurality of printed wiring boards. Each of the plurality of steerable antennas includes at least one parasitic antenna element provided on at least one of the plurality of printed wiring boards.

Advantageous Effects of Invention

In order to solve the above-described problems of the prior art, an array antenna apparatus of the present invention is configured as follows. Each parasitic antenna element has a space at the middle of the parasitic element, and is provided with a pair of rectifier elements (e.g., PIN diodes) connected in series such that their anode terminals oppose to each other, and the rectifier elements are connected through control lines to bias voltage supply means (controller) such that their anode terminals are connected to an on/off terminal of the bias voltage supply means and their cathode terminals are connected to a GND terminal of the bias voltage supply means. In addition, inductors with a certain inductance are inserted to each control line at predetermined intervals, at portions of the control line that are electromagnetically coupled to a steerable antenna (preferably, inserted at three points in total, i.e., a point on the control line that is closest to an adjacent steerable antenna, and two points on the control line each remote from the closest point by a predetermined distance). The distances between the inductors are preferably set to a length different from an integral multiple of one-quarter of an operating wavelength for communication, e.g., set to a length shorter than one-quarter of the operating wavelength.

When a voltage from the controller is lower than an operating voltage of a diode, the diode is equivalent to a series connected circuit of small capacitance and impedance, and accordingly, the parasitic antenna element does not affect antenna radiation, thus resulting in omnidirectional radiation. On the other hand, when a voltage from the controller is higher than the operating voltage of the diode, the diode becomes conductive, and thus, the parasitic antenna element acts as a reflector. By using this circuitry, even when operating in a high-frequency range where variable reactance elements are not operable, it is possible to change a MIMO antenna's directivity.

Moreover, the inductors inserted to the control lines prevent undesirable resonances in the control lines. By setting the distances between the inductors to be shorter than one-quarter of the operating wavelength, the resonance frequency of the control lines becomes higher than the operating frequency. By using such a configuration, it is possible to prevent that resonances in the control lines affect the directivity of an adjacent antenna.

BRIEF DESCRIPTION OF DRAWINGS

FIG. 6 is a graph showing the a simulation result for the first embodiment of the present invention, and showing a directivity pattern of the steerable antenna 100 obtained when the control voltage to the parasitic antenna element 111 is turned on;

REFERENCE SIGNS LIST

Figure 1:
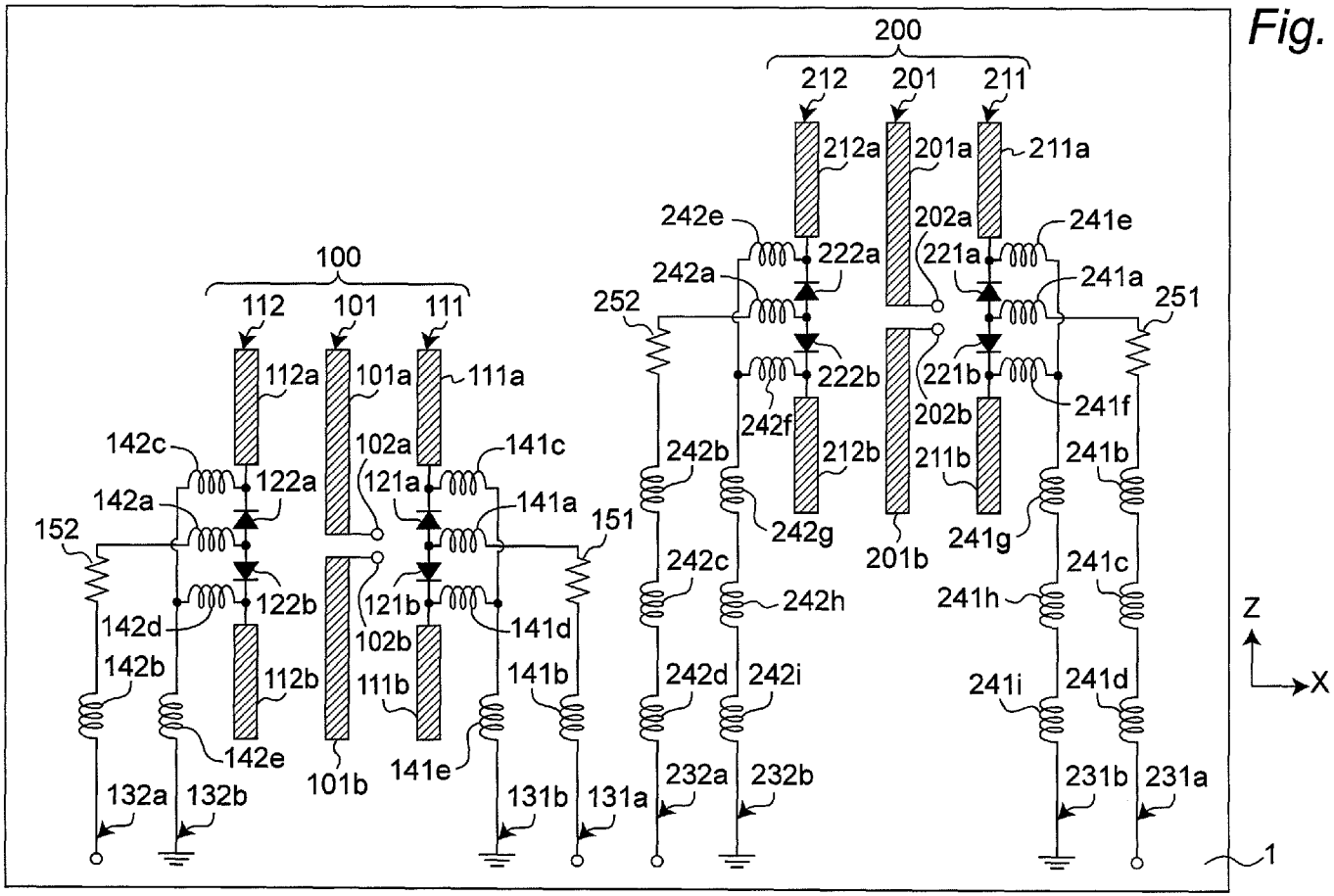
FIG. 1 is a plan view showing a schematic configuration of an array antenna apparatus according to a first embodiment of the present invention.

1, 1*a*, 1*b*, 1*c*: printed wiring board,
10: terminal group,
100, 100A, 200, 200A, 300: steerable antenna,
101, 201, 301: dipole antenna element,
101*a*, 101*b*, 201*a*, 201*b*: radiating conductor element,
102*a*, 102*b*, 202*a*, 202*b*: feeding point,
111, 112, 113, 114, 211, 212, 213, 214, 311, 312: parasitic antenna element,
111*a*, 111*b*, 112*a*, 112*b*, 113*a*, 113*b*, 114*a*, 114*b*, 211*a*, 211*b*, 212*a*, 212*b*, 213*a*, 213*b*, 214*a*, 214*b*: parasitic conductor element,
121*a*, 121*b*, 122*a*, 122*b*, 123*a*, 123*b*, 124*a*, 124*b*, 221*a*, 221*b*, 222*a*, 222*b*, 223*a*, 223*b*, 224*a*, 224*b*: PIN diode,
131*a*, 131*aa* to 131*ac*, 131*b*, 131*ba* to 131*b g*, 132*a*, 132*b*, 133*a*, 133*b*, 134*a*, 134*b*, 231*a*, 231*b*, 232*a*, 232*aa* to 232*ad*, 232*b*, 232*ba* to 232*bd*, 233*a*, 233*b*, 234*a*, 234*b*: control line,
141*a* to 141*e*, 142*a* to 142*e*, 143*a* to 143*e*, 144*a* to 144*e*, 241*a* to 241*i*, 242*a* to 242*i*, 243*a* to 243*i*, 244*a* to 244*i*: inductor,
151, 152, 153, 154, 251, 252, 253, 254: resistor,
T1, T2: through-hole conductor,
E1*a*, E1*b*, E2*a*, E2*b*, E3*a*, E3*b*, E4*a*, E4*b*, E5*a*, E5*b*, E6*a*, E6*b*, E7*a*, E7*b*, E8*a*, E8*b*, E9*a*, E9*b*, E10*a*, E10*b*, E11*a*, E11*b*, E12*a*, E12*b*: electrode terminal.

DESCRIPTION OF EMBODIMENTS

Preferred embodiments for implementing the present invention will be described below with reference to the drawings. Note that components having similar functions are denoted by the same reference numerals throughout the specification and drawings, and are not explained repeatedly.

First Preferred Embodiment

Figure 2:
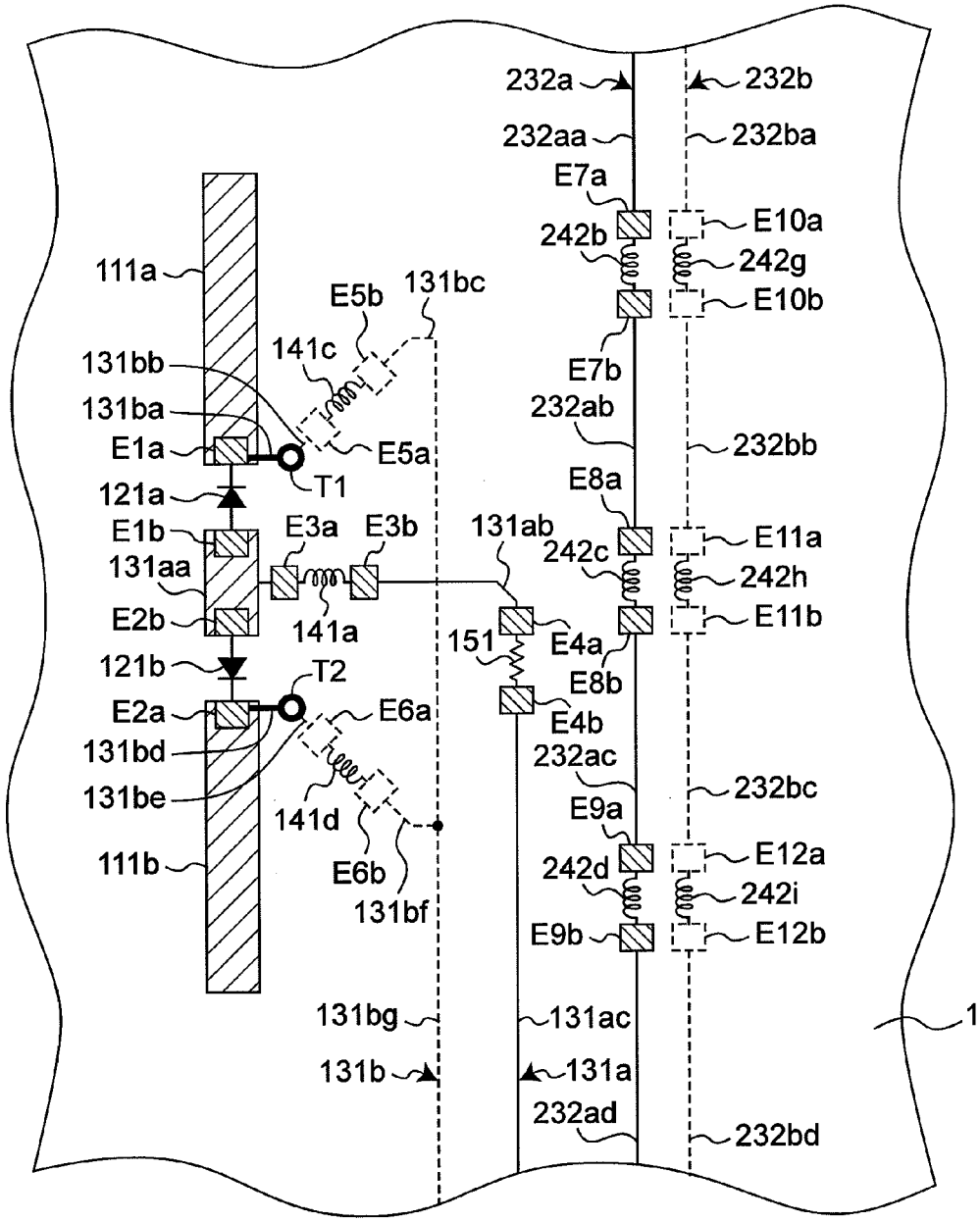
FIG. 2 is a detailed view of a part of the array antenna apparatus of FIG. 1 in phantom.

FIG. 1 is a plan view showing a schematic configuration of an array antenna apparatus according to a first embodiment of the present invention. FIG. 2 is a detailed view of a part of FIG. 1 in phantom. An array antenna apparatus according to the present embodiment includes two sets of steerable antennas 100 and 200 on a printed wiring board 1. Note that the XYZ coordinate is used as shown in FIG. 1, and for a Y-axis, a direction from front to back of FIG. 1 is assumed to be a positive direction.

The steerable antenna 100 includes one half-wave dipole antenna element 101 as an radiating antenna element, and two parasitic antenna elements 111 and 112. The dipole antenna element 101 includes two strip radiating conductor elements 101*a* and 101*b*, each formed as a conductor pattern on the printed wiring board 1. The radiating conductor elements 101*a* and 101*b* oppose to each other with a space therebetween, and are located along a straight line. Feeding points 102*a* and 102*b* are respectively provided at opposing ends of the radiating conductor elements 101*a* and 101*b*, and connected to a wireless communication circuit (not shown) through a balanced radio frequency cable (not shown), thus transmitting and receiving radio signals through the dipole antenna element 101. Each of the parasitic antenna elements 111 and 112 is located on a line parallel to the straight line of the dipole antenna element 101 so as to be separated from the straight line by one-quarter of an operating wavelength for communication, such that the dipole antenna element 101 is positioned between the parasitic antenna elements 111 and 112. The parasitic antenna element 111 also includes two strip parasitic conductor elements 111*a* and 111*b*, each formed as a conductor pattern on the printed wiring board 1. The parasitic conductor elements 111*a* and 111*b* oppose to each other with a space therebetween, and are located along a straight line. A pair of PIN diodes 121*a* and 121*b* are respectively provided at opposing ends of the parasitic conductor elements 111*a* and 111*b*. A cathode terminal of the PIN diode 121*a* is connected to the parasitic conductor element 111*a*, a cathode terminal of the PIN diode 121*b* is connected to the parasitic conductor element 111*b*, and anode terminals of the PIN diodes 121*a* and 121*b* are connected to each other. The anode terminals of the PIN diodes 121*a* and 121*b* are connected through a control line 131*a* to a bias voltage supply terminal (DC terminal) of a controller (not shown) for controlling the directivity of the array antenna apparatus by applying a control voltage (i.e., a bias voltage). The cathode terminals of the PIN diodes 121*a* and 121*b* are connected through a control line 131*b* to a ground terminal (GND terminal) of the controller. Thus, the control lines 131*a* and 131*b* are a DC voltage supply line and a GND line for controlling the parasitic antenna element 111, respectively.

A radio frequency choke inductor (coil) 141*a* having, e.g., an inductance of about several tens of nH is provided on the control line 131*a* so as to be close to the anode terminals of the PIN diodes 121*a* and 121*b*. On the control line 131*a*, a current control resistor 151 of about several hundreds of ohms is further provided. In addition, radio frequency choke inductors 141*c* and 141*d* having, e.g., an inductance of about several tens of nH are provided on the control line 131*b* so as to be close to the cathode terminals of the PIN diodes 121*a* and 121*b*. In this case, the inductors 141*a*, 141*c*, and 141*d* serve to prevent a radio-frequency signal exciting at the parasitic antenna element 111 from leaking to the control lines 131*a* and 131*b*. On the control lines 131*a* and 131*b*, inductors having, e.g., an inductance of about several nH are further provided at predetermined intervals for preventing the control lines 131*a* and 131*b* from resonating with a radio wave radiated from the steerable antenna 100 or the other steerable antenna, and thus for avoiding the resonation affecting radiations of the steerable antennas. FIG. 1 shows an example in which an inductor 141*b* on the control line 131*a* and an inductor 141*e* on the control line 131*b* are provided. It is described below in a detailed manner how to mount inductors for preventing undesirable resonances.

Furthermore, the parasitic antenna element 112 is also configured in a similar manner as that of the parasitic antenna element 111. The parasitic antenna element 112 includes parasitic conductor elements 112*a* and 112*b*, which are configured and located in a similar manner as that of the parasitic conductor elements 111*a* and 111*b* of the parasitic antenna element 111. At opposing ends of the parasitic conductor elements 112*a* and 112*b*, a pair of PIN diodes 122*a* and 122*b* is provided in a similar manner as that of the PIN diodes 121*a* and 121*b* connected to the parasitic antenna element 111. The PIN diodes 122*a* and 122*b* are connected to the controller of the array antenna apparatus through control lines 132*a* and 132*b*. On the control lines 132*a* and 132*b*, inductors 142*a* to 142*e* and a resistor 152 are provided in a similar manner as that of the inductors 141*a* to 141*e* and the resistor 151 on the control lines 131*a* and 131*b*.

Figure 3:
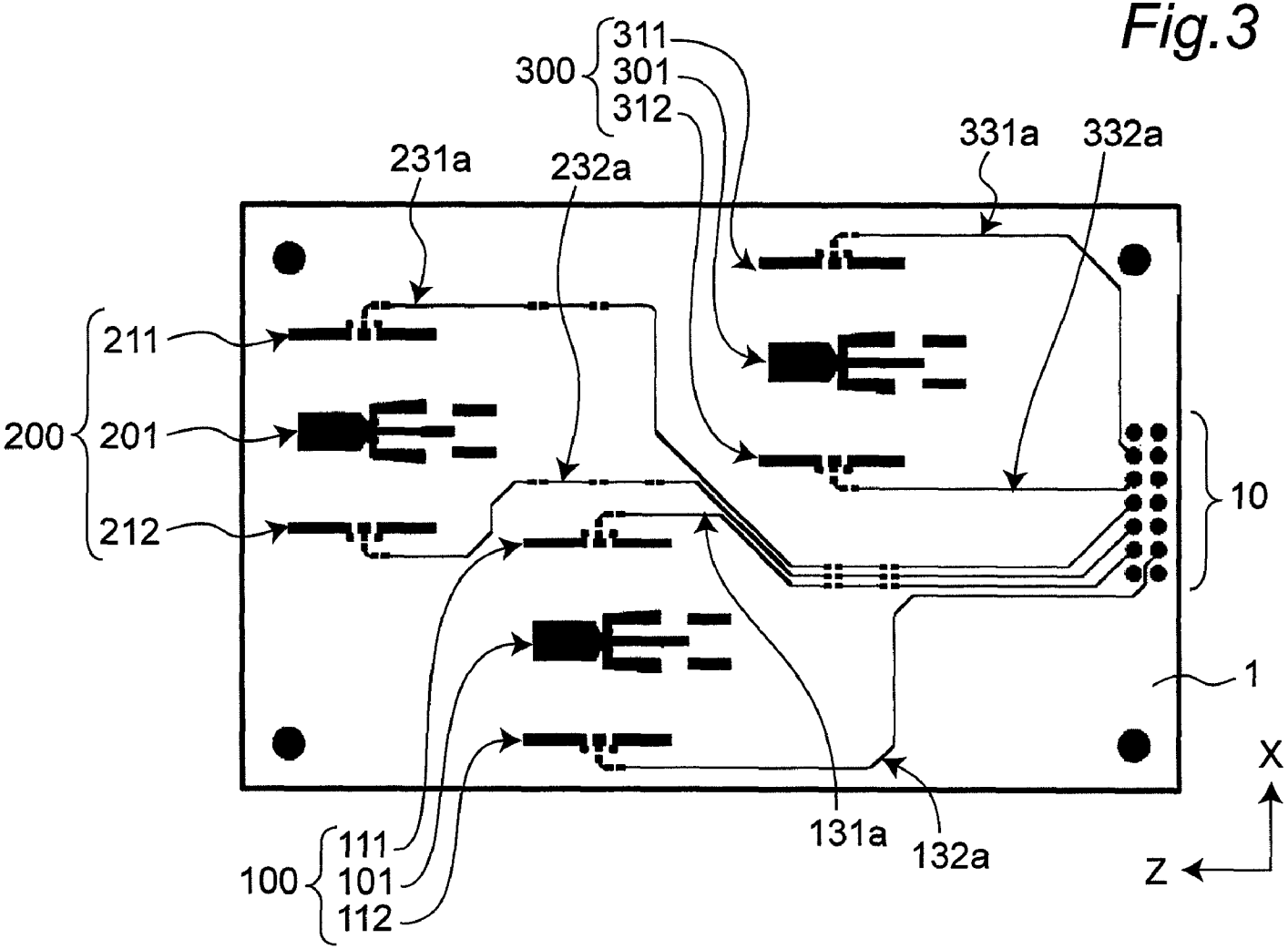
FIG. 3 is a plan view showing a printed wiring board 1 according to an implementation example of the first embodiment of the present invention.
Figure 4:
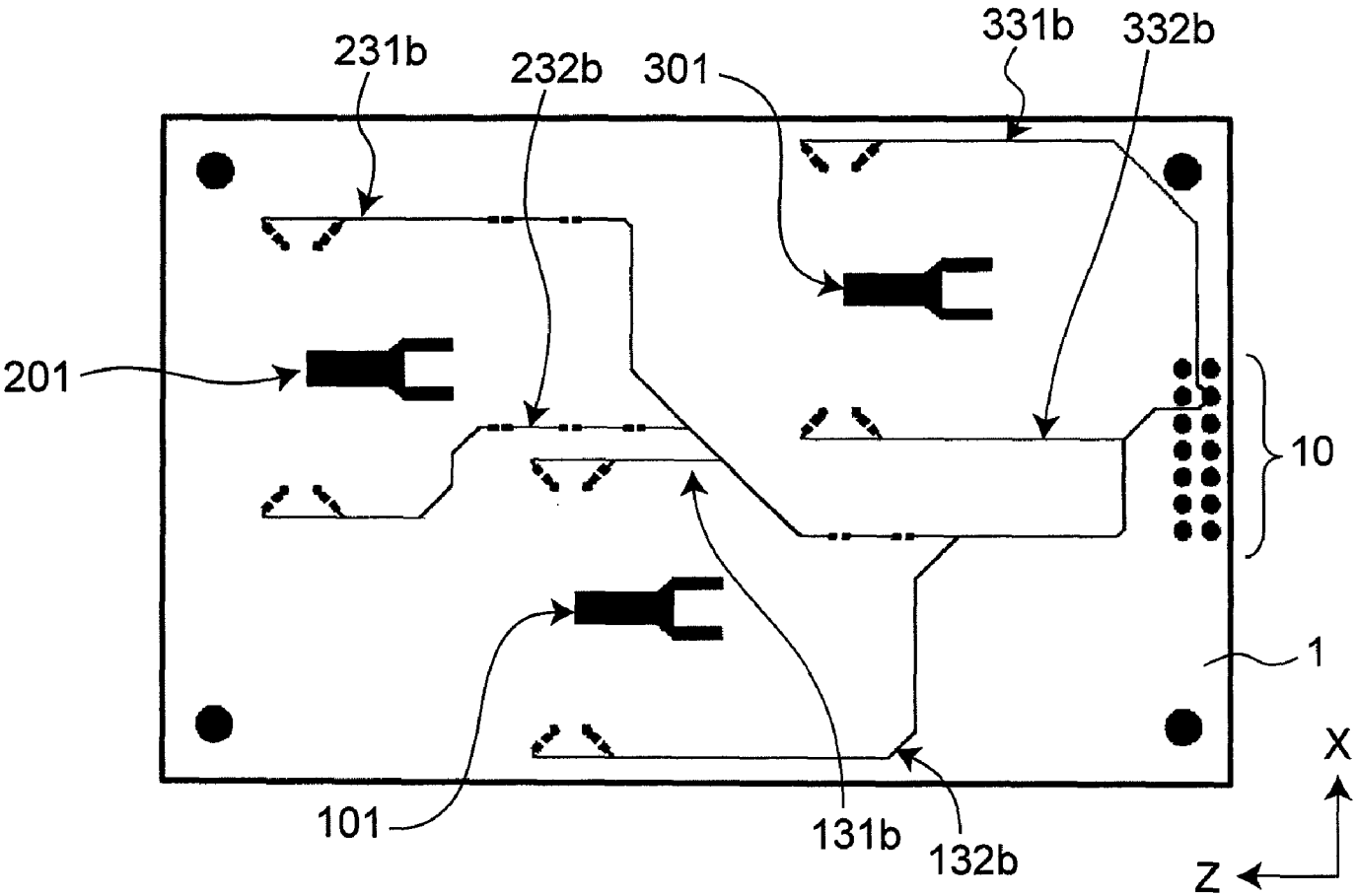
FIG. 4 is a plan view showing an underside of the printed wiring board 1 of FIG. 3 in phantom.

The steerable antenna 200 also includes one dipole antenna element 201 and two parasitic antenna elements 211 and 212, in a similar manner as that of the steerable antenna 100. The parasitic antenna element 211 is connected with PIN diodes 221*a* and 221*b*, and the parasitic antenna element 212 is connected with PIN diodes 222*a* and 222*b*. The PIN diodes 221*a* and 221*b* are connected to the controller of the array antenna apparatus through control lines 231*a* and 231*b*, and the PIN diodes 222*a* and 222*b* are connected to the controller of the array antenna apparatus through control lines 232*a* and 232*b*. On the control lines 231*a* and 231*b*, inductors 241*a*, 241*e*, and 241*f* and a resistor 251 are provided in a similar manner as that of the inductors 141*a*, 141*c*, and 141*d* and the resistor 151 on the control lines 131*a* and 131*b*. Furthermore, in a similar manner as that of the inductors 141*b* and 141*e* on the control lines 131*a* and 131*b*, inductors are provided on the control lines 231*a* and 231*b* at predetermined intervals for preventing the control lines 231*a* and 231*b* from resonating with a radio wave radiated from the steerable antenna 200 or the other steerable antenna, and thus for avoiding the resonation affecting radiations of the steerable antennas. FIG. 1 shows an example in which inductors 241*b*, 241*c*, and 241*d* on the control line 231*a* and inductors 241*g*, 241*h*, and 241*i* on the control line 231*b* are provided. It is described below in a detailed manner how to mount inductors for preventing undesirable resonances. In addition, on the control lines 232*a* and 232*b*, inductors 242*a* to 242*i* and a resistor 252 are provided in a similar manner as that of the inductors 241*a* to 241*i* and the resistor 251 on the control lines 231*a* and 231*b*. In the present embodiment, the directions and positions of the steerable antennas 100 and 200 are determined such that when both of the steerable antennas 100 and 200 operate in omnidirectional patterns, their respective radiation directions do not overlap one another. In the case of FIG. 1, the respective half-wave dipole antenna elements 101 and 201 of the steerable antennas 100 and 200 are provided in parallel with a Z-axis direction, and are located at different positions along the Z-axis direction. Accordingly, the parasitic antenna elements 111, 112, 211, and 212 are also provided in parallel with the Z-axis direction, and are located at different positions along the Z-axis direction. This configuration aims to prevent the correlation between antennas from increasing when the antennas are arranged in close to each other, and thus avoid degradation in communication quality of the MIMO scheme. In another exemplary case of an array antenna apparatus including three steerable antennas 100, 200, and 300 as shown in FIGS. 3 and 4, it is preferable that the steerable antennas 100, 200, and 300 be arranged such that a line passing through a any pair of steerable antennas has a direction different from that of a line passing through another pair of steerable antennas, and also different from a direction of dipole antenna elements (in this case, a direction parallel to a Z-axis).

In the case of the configuration of FIG. 1, the control lines 232*a* and 232*b* for one steerable antenna 200 pass near the parasitic antenna element 111 of the other steerable antenna 100. Furthermore, preferably, the printed wiring board 1 is configured as a double-sided board, and the control lines 131*a*, 131*b*, 132*a*, 132*b*, 231*a*, 231*b*, 232*a*, and 232*b* are provided on both sides of the printed wiring board 1 as conductor patterns. In the present embodiment, the control lines 131*a*, 132*a*, 231*a*, and 232*a* connected to the DC terminal of the controller of the array antenna apparatus are provided on the same side as the steerable antennas 100 and 200, and the control lines 131*b*, 132*b*, 231*b*, and 232*b* connected to the GND terminal of the controller of the array antenna apparatus are substantially provided on the opposite side.

FIG. 2 is an enlarged view of a portion including the parasitic antenna element 111 and the control lines 232*a* and 232*b* adjacent thereto. In this case, the control line 131*a* includes control lines 131*aa* to 131*ac*, each forming a part thereof. Similarly, the control line 131*b* includes control lines 131*ba* to 131*bg*, the control line 232*a* includes control lines 232*aa* to 232*ad*, and the control line 232*b* includes control lines 232*ba* to 232*bd*. The control lines 131*bb*, 131*bc*, and 131*be* to 131*bg* and the control lines 232*ba* to 232*bd* are provided on the back side of the printed wiring board 1, and are shown by dotted lines in FIG. 2. The control line 131*aa* is provided at a position between the parasitic conductor elements 111*a* and 111*b* of the parasitic antenna element 111. The PIN diode 121*a* is mounted by soldering etc. on electrode terminals E1*a* and E1*b* which are respectively provided on the parasitic conductor element 111*a* and the control line 131*aa* at positions where the parasitic conductor element 111*a* and the control line 131*aa* are close to each other. Similarly, the PIN diode 121*b* is mounted on electrode terminals E2*a* and E2*b* which are respectively provided on the parasitic conductor element 111*b* and the control line 131*aa* at positions where the parasitic conductor element 111*b* and the control line 131*aa* are close to each other. In this case, the anode terminals of the PIN diodes 121*a* and 121*b* are respectively connected to the electrode terminals E1*b* and E2*b* on the control line 131*aa*. The inductor 141*a* is mounted on electrode terminals E3*a* and E3*b* respectively provided at opposing ends of the control lines 131*aa* and 131*ab*. The resistor 151 is mounted on electrode terminals E4*a* and E4*b* respectively provided at opposing ends of the control lines 131*ab* and 131*ac*. The control line 131*ac* is further connected to the bias voltage supply terminal of the controller of the array antenna apparatus. The electrode terminals E1*a* and E2*a* are respectively connected to through-hole conductors T1 and T2 through the control lines 131*ba* and 131*bd*. The through-hole conductors T1 and T2 pass through to the back side of the printed wiring board 1, and are respectively connected to the control lines 131*bb* and 131*be*. The inductor 141*c* is mounted on electrode terminals E5*a* and E5*b* respectively provided at opposing ends of the control lines 131*bb* and 131*bc*. The inductor 141*d* is mounted on electrode terminals E6*a* and E6*b* respectively provided at opposing ends of the control lines 131*be* and 131*bf*. Furthermore, both of the control lines 131*bc* and 131*bf* are connected to the control line 131*bg*, and then, the control line 131*bg* is connected to the GND terminal of the controller of the array antenna apparatus. As described above, on the control lines 131*a* and 131*b*, inductors are provided at predetermined intervals for preventing the control lines 131*a* and 131*b* from resonating with a radio wave radiated from the steerable antenna 100 or the other steerable antenna, and thus for avoiding the resonation affecting radiations of the steerable antennas. Further, also on the control lines 232*a* and 232*b*, inductors are also provided at predetermined intervals for preventing the control lines 232*a* and 232*b* from resonating with a radio wave radiated from the steerable antenna 200 or the other steerable antenna, and thus for avoiding the resonation affecting radiations of the steerable antennas. On the control line 232*a*, the inductor 242*b* is mounted on electrode terminals E7*a* and E7*b* respectively provided at opposing ends of the control lines 232*ac* and 232*ab*, the inductor 242*c* is mounted on electrode terminals E8*a* and E8*b* respectively provided at opposing ends of the control lines 232*ab* and 232*ac*, and the inductor 242*d* is mounted on electrode terminals E9*a* and E9*b* respectively provided at opposing ends of the control lines 232*ac* and 232*ad*. Similarly, on the control line 232*b*, the inductor 242*g* is mounted on electrode terminals E10*a* and E10*b* respectively provided at opposing ends of the control lines 232*ba* and 232*bb*, the inductor 242*h* is mounted on electrode terminals E11*a* and E11*b* respectively provided at opposing ends of the control lines 232*bb* and 232*bc*, and the inductor 242*i* is mounted on electrode terminals E12*a* and E12*b* respectively provided at opposing ends of the control lines 232*bc* and 232*bd*.

In the steerable antennas 100 and 200 of the array antenna apparatus configured as above, when the control voltage from the controller is off, a voltage is not applied from the DC terminal thereof, and thus, each of the PIN diodes 121*a*, 121*b*, 122*a*, 122*b*, 221*a*, 221*b*, 222*a*, and 222*b* is equivalent to a series connected circuit of small capacitance and impedance. Accordingly, the parasitic antenna elements 111, 112, 211, and 212 are not excited, and thus do not affect the directivities of the steerable antennas 100 and 200. On the other hand, when the controller turns on a control voltage to, e.g., the parasitic antenna element 111, the controller applies bias voltages from the DC terminal to the anodes of the PIN diodes 121*a* and 121*b* through the control line 131*a* such that the applied bias voltages are higher than an operating voltage of the PIN diodes 121*a* and 121*b*, e.g., about 0.8 V, and thus, the PIN diodes 121*a* and 121*b* become conductive. At this time, the parasitic antenna element 111 is excited by a radio wave radiated from the dipole antenna element 101, and re-radiates a radio wave. Since the separation between the dipole antenna element 101 and the parasitic antenna element 111 is one-quarter of an operating wavelength, the radio wave re-radiated from the parasitic antenna element 111 has a phase delayed by 90 degrees with respect to the radio wave radiated from the dipole antenna element 101. As a result of superposition of these two radio waves, radio waves propagating in +X direction relative to the parasitic antenna element 111 are cancelled, and radio waves propagating in −X direction relative to the dipole antenna element 101 are increased. As such, when a bias voltage is applied to the parasitic antenna element 111, the parasitic antenna element 111 operates as a reflector for the dipole antenna element 101, and thus, the directivity of the steerable antenna 100 can be changed so as to steer its beam in −X direction. Moreover, when other parasitic antenna elements 112, 211, and 212 are turned on, directivities can be similarly controlled.

Meanwhile, when antennas are arranged to avoid their correlations as in the present embodiment, the control lines 232*a* and 232*b* for the steerable antenna 200 are laid close to the steerable antenna 100, and thus, the steerable antenna 100 and the control lines 232*a* and 232*b* are electromagnetically coupled to each other. When a conductor line is laid near an antenna, the conductor line is often excited by a radio wave radiated from the antenna, and thus acts as a reflector to change the antenna's directivity. The inductors 242*b* to 242*d* and 242*g* to 242*i* respectively provided on the control lines 232*a* and 232*b* serve to prevent this phenomenon. As an example, an explanation is shown below based on the control line 232*a* and the inductors 242*b* to 242*d* provided thereon. The inductors 242*b* to 242*d* are provided on the control line 232*a* at portions of the control line 232*a* that are electromagnetically coupled to the steerable antenna 100. The inductors 242*b* to 242*d* are preferably inserted at three points in total, i.e., a point on the control line 232*a* that is closest to the adjacent steerable antenna 100, and two points on the control line 232*a* each remote from the closest point by a predetermined distance. A radio wave radiated from the steerable antenna 100 excites the control line 232*ab* between the inductors 242*b* and 242*c* on the control line 232*a*, and the control line 232*ac* between the inductors 242*c* and 242*d* on the control line 232*a*. If the frequency at which the control lines 232*ab* and 232*ac* are excited is the same as the operating frequency of the steerable antenna 100 for communication, then the control lines 232*ab* and 232*ac* act as reflectors at that frequency, thus affecting the directivity of the steerable antenna 100. In this case, undesirable resonances in the control line 232*a* are prevented by setting the distances between the inductors 242*b*, 242*c*, and 242*d* to be such a length that substantially no resonance occurs at the operating frequency of the steerable antenna 100. Specifically, the distances between the inductors are set to be a length different from an integral multiple of one-quarter of an operating wavelength $\lambda(n\lambda/4)$, e.g., a length longer or shorter than $n\lambda/4$ by at least 10%. Preferably, the distances between the inductors are set to be a length different from $n\lambda/4$, and further set to be a length of less than $\lambda/2$ or less than $\lambda/4$ relative to the operating wavelength $\lambda$, and thus, the resonant frequency of the control lines 232*ab* and 232*ac* becomes higher than the operating frequency of the steerable antenna 100, thus preventing undesirable resonances in the control line 232*a*. By using the configuration described above, it is possible to reduce the influence exerted on the directivity of the steerable antenna 100 by the control line 232*a* of the steerable antenna 200. The control line 232*b* and the inductors 242*g* to 242*i* provided thereon are configured in a similar manner, thus preventing undesirable resonances in the control line 232*b*. Also on each of other control lines 131*a*, 131*b*, 132*a*, 132*b*, 231*a*, and 231*b*, undesirable resonances in the control line are prevented by providing inductors on the control line at predetermined intervals at portions of the control line which are close to and electromagnetically coupled to its adjacent steerable antenna (not shown).

Preferably, on each control line, in order to prevent the control line from affecting the radiation of a steerable antenna to which the control line is connected, at least one inductor is provided at a portion that is close to and electromagnetically coupled to the steerable antenna. For example, on the control line 131*a*, the inductor 141*b* is provided such that the length of the control line 131*a* from the inductor 141*b* to the PIN diodes 121*a* and 121*b* (or the length of the control line 131*a* from the inductor 141*b* to the inductor 141*a* or the resistor 151) is a length different from $n\lambda/4$ (e.g., a length of less than $\lambda/4$). By using this configuration, the length of a portion of the control line 131*a* that is close to and electromagnetically coupled to the steerable antenna 100 is such a length that substantially no resonance occurs at the operating frequency of the steerable antenna 100, thus preventing undesirable resonances in the control line 131*a*. Also on each of other control lines 131*b*, 132*a*, 132*b*, 231*a*, 231*b*, 232*a*, and 232*b*, undesirable resonances in the control line are prevented by providing at least one inductor on the control line at a portion of the control line that is close to and electromagnetically coupled to a steerable antenna to which the control line is connected.

FIG. 3 is a plan view showing a printed wiring board 1 according to an implementation example of the first embodiment of the present invention. FIG. 4 is a plan view showing the underside of the printed wiring board 1 of FIG. 3 in phantom. In the implementation example, an array antenna apparatus includes another steerable antenna 300 configured in a similar manner as that of steerable antennas 100 and 200. As in the case of the steerable antennas 100 and 200, the steerable antenna 300 includes one dipole antenna element 301 and two parasitic antenna elements 311 and 312, and PIN diodes (not shown) are respectively connected to the parasitic antenna elements 311 and 312, and are controlled by a controller of the array antenna apparatus through control lines 331*a*, 331*b*, 332*a*, and 332*b*. Respective Control lines of the steerable antennas 100, 200, and 300 are extended to a terminal group 10 on the printed wiring board 1, and connected to the controller. When numbers of steerable antennas are formed on one printed wiring board 1, it is preferable that the steerable antennas are not aligned on one straight line, for the purpose of obtaining an area for routing control lines. For example, it is preferable that steerable antennas be arranged such that a line passing through a any pair of steerable antennas has a direction different from that of a line passing through another pair of steerable antennas, and also different from a direction of dipole antenna elements. By using such a configuration, it is possible to reduce the area for arranging steerable antennas, and for example, achieve area reduction to the extent that the distances between the steerable antennas are λ/2 or less.

Figure 5:
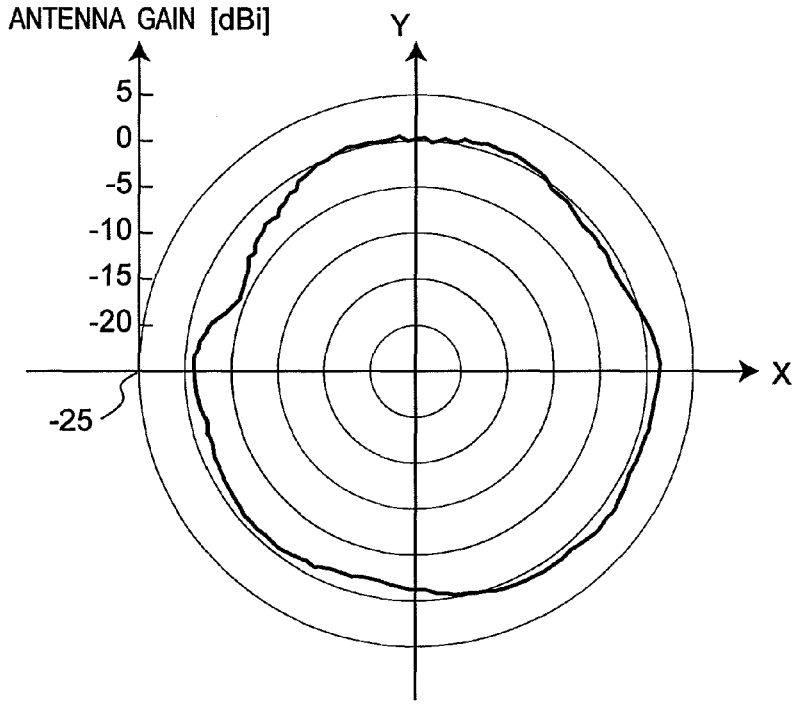
FIG. 5 is a graph showing a simulation result for the first embodiment of the present invention, and showing a directivity pattern of a steerable antenna 100 obtained when control voltages to parasitic antenna elements 111 and 112 are turned off.
Figure 6:
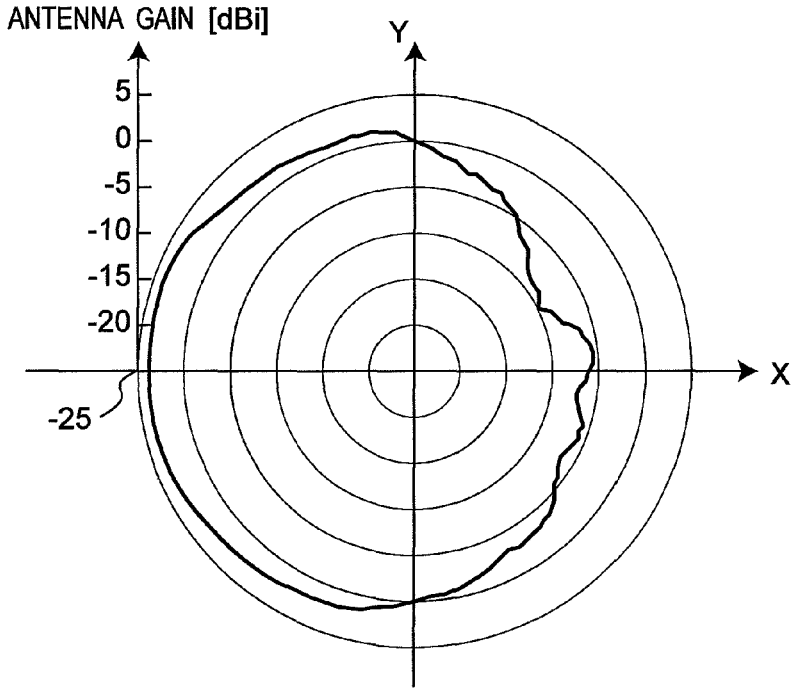

FIGS. 5 and 6 show simulation results for the first embodiment of the present invention. FIG. 5 is a graph showing a directivity pattern of the steerable antenna 100 obtained when control voltages to the parasitic antenna elements 111 and 112 are turned off. FIG. 6 is a graph showing a directivity pattern of the steerable antenna 100 obtained when the control voltage to the parasitic antenna element 111 is turned on. Simulations of FIGS. 5 and 6 show measurement results of directivities of the steerable antenna 100 of the array antenna apparatus configured on the printed wiring board 1 of FIGS. 3 and 4, measured in a radio anechoic chamber. Particularly, referring to FIG. 6, it can be seen that when the parasitic antenna element 111 located in +X direction relative to the dipole antenna element 101 is operated as a reflector, a beam is steered in −X direction. Moreover, when turning on a control voltage to the parasitic antenna element 112 instead of the parasitic antenna element 111, the parasitic antenna element 112 operates as a reflector, and thus a beam is steered in +X direction.

Although the present embodiment shows the case of using the dipole antenna elements 101 and 201 as radiating antenna elements, any antenna element can be used as long as having a horizontal directivity which is nearly omnidirectional. Accordingly, even when sleeve antennas or collinear antennas are used, it is possible to implement an array antenna apparatus operable in a similar manner as that of the present embodiment. In addition, although the present embodiment shows examples in which the two steerable antennas 100 and 200 or the three steerable antennas 100, 200, and 300 are arranged on the printed wiring board 1, four or more steerable antennas may be arranged.

As described above, the array antenna apparatus of the present embodiment is provided with pairs of PIN diodes each pair being connected to each other at their anodes, and further provided with inductors on each control line at predetermined intervals. Thus, it is possible to provide an array antenna apparatus with a circuitry for controlling directivity, capable of changing between "radiation in an omnidirectional pattern" and "radiation with a beam in a specific direction" even when operating in a centimeter-wave range of several GHz to several tens of GHz or when reducing the distances between steerable antennas, and thus suitable for a MIMO communication scheme.

Second Preferred Embodiment

Figure 7:
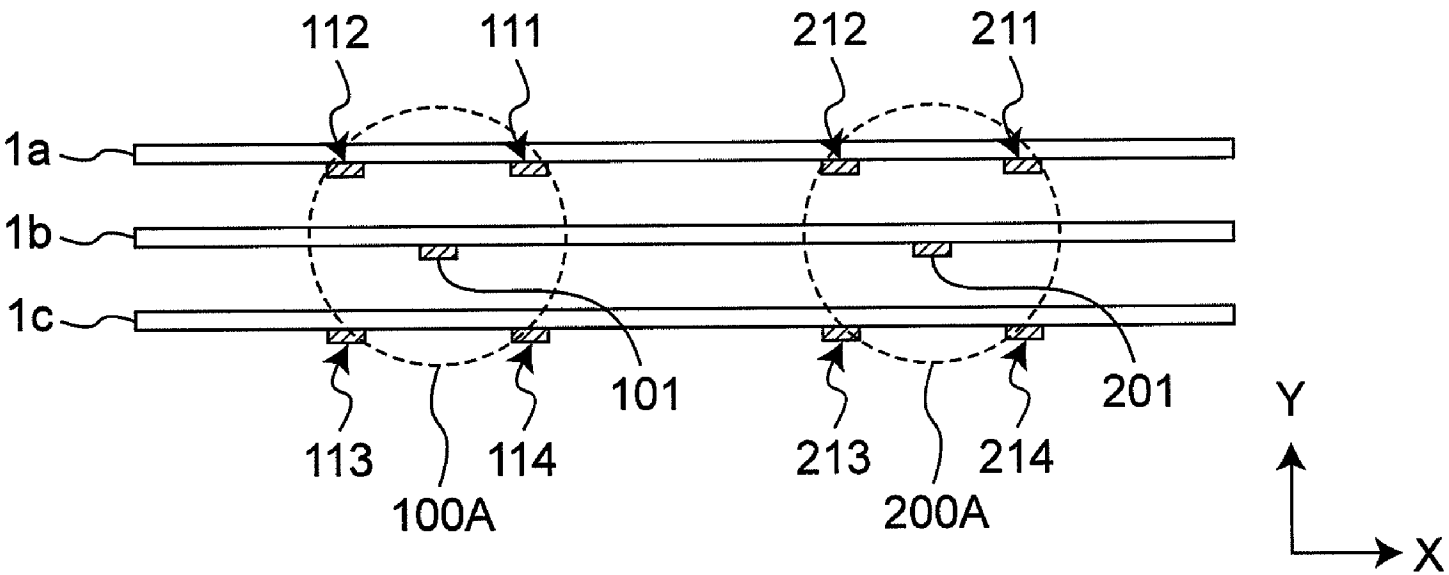
FIG. 7 is a top view showing a schematic configuration of an array antenna apparatus according to a second embodiment of the present invention.
Figure 8:
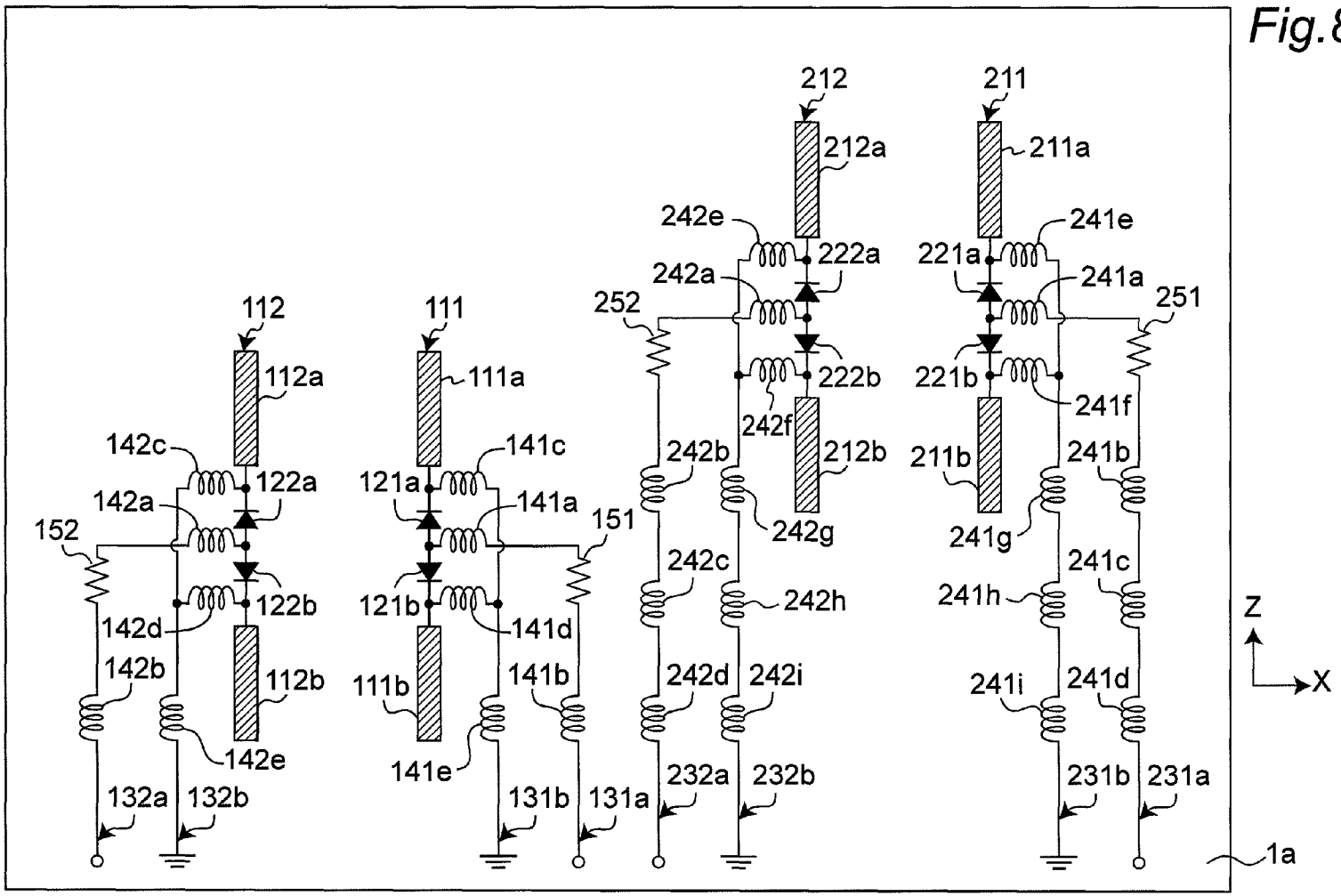
FIG. 8 is a plan view showing a schematic configuration of a printed wiring board 1*a* of FIG. 7.
Figure 9:
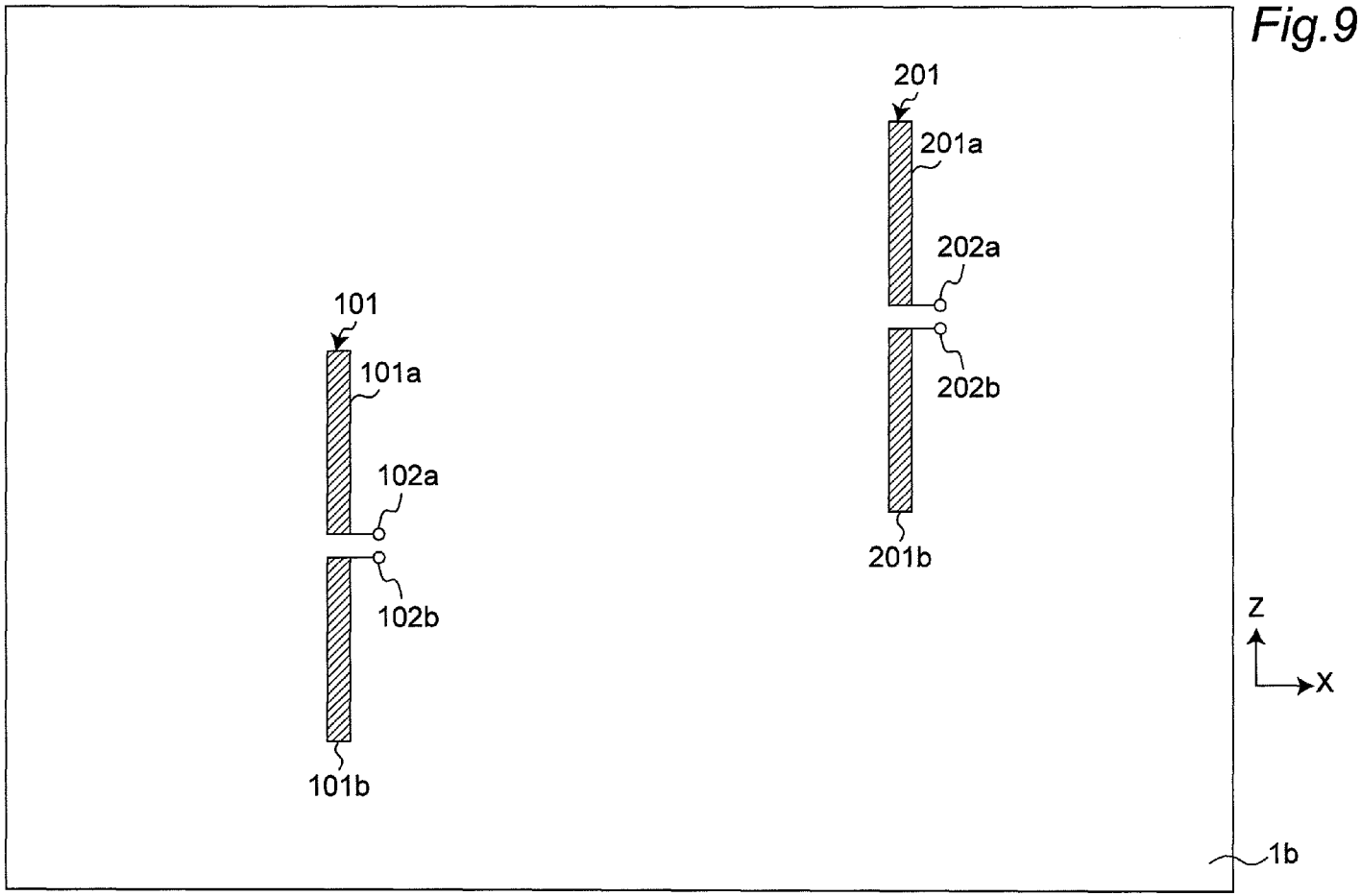
FIG. 9 is a plan view showing a schematic configuration of a printed wiring board 1*b* of FIG. 7.
Figure 10:
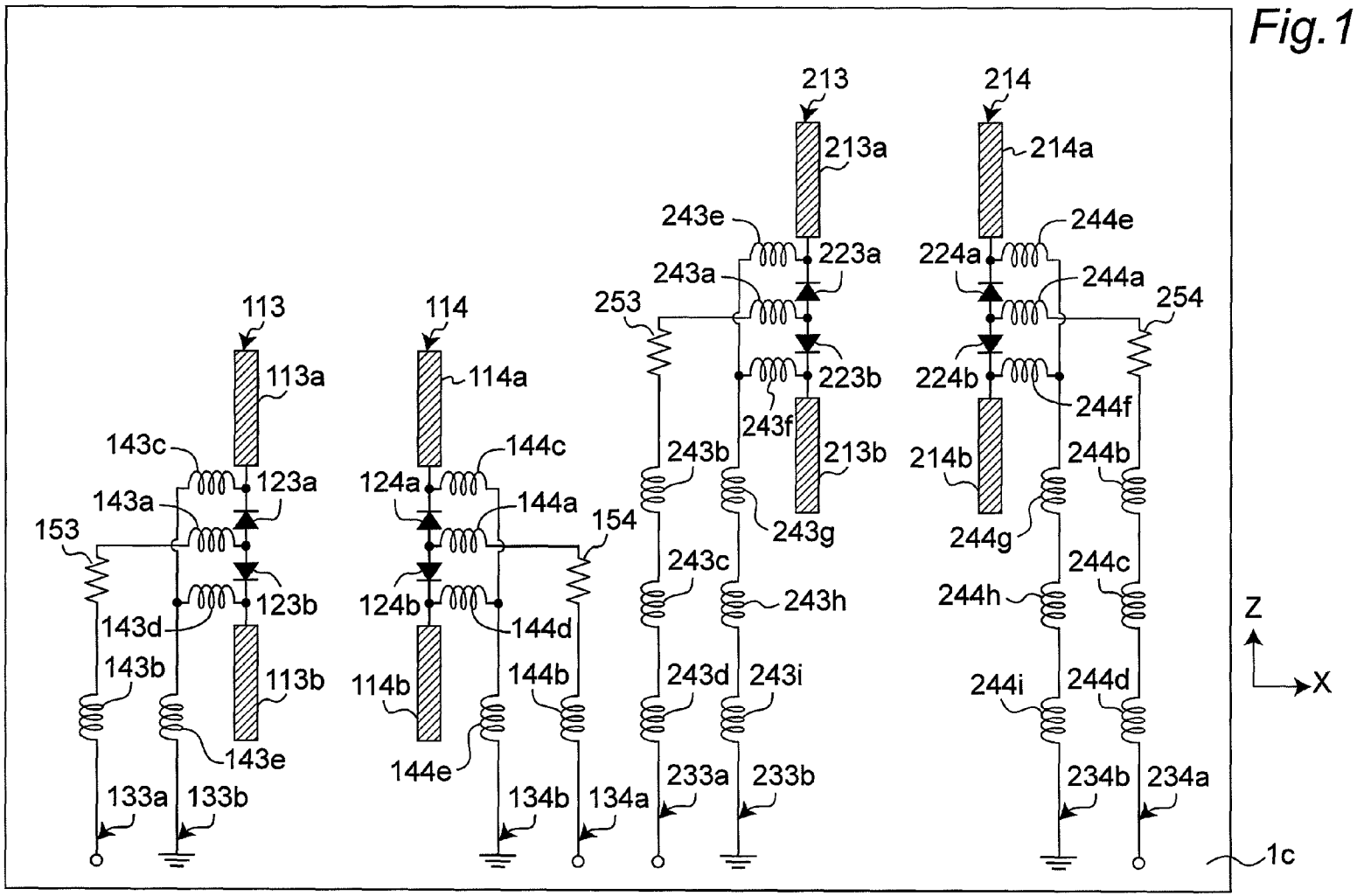
FIG. 10 is a plan view showing a schematic configuration of a printed wiring board 1*c* of FIG. 7.

FIG. 7 is a top view showing a schematic configuration of an array antenna apparatus according to a second embodiment of the present invention. FIGS. 8 to 10 are plan views respectively showing schematic configurations of printed wiring boards 1*a*, 1*b*, and 1*c* of FIG. 7. The array antenna apparatus according to an embodiment of the present invention is not limited to the one in which antennas are formed within a plane of one printed wiring board 1 as in the first embodiment, but may have a three dimensional configuration in which three or more parasitic antenna elements are provided so as to surround an radiating antenna element.

As shown in FIG. 7, an array antenna apparatus according to the present embodiment includes two sets of steerable antennas 100A and 200A, on the three printed wiring boards 1*a*, 1*b*, and 1*c* provided in parallel with each other. The steerable antenna 100A includes one half-wave dipole antenna element 101 as an radiating antenna element, and four parasitic antenna elements 111 to 114. The dipole antenna element 101 is provided on the middle printed wiring board 1*b*, the parasitic antenna elements 111 and 112 are provided on the printed wiring board 1*a*, and the parasitic antenna elements 113 and 114 are provided on the printed wiring board 1*c*. When the array antenna apparatus according to the present embodiment is seen from the top (from a Z-axis direction), the four parasitic antenna elements 111 to 114 are arranged on a circle with its center at the dipole antenna element 101. Preferably, each of the parasitic antenna elements 111 to 114 is located on a line parallel to the straight line of the dipole antenna element 101 so as to be separated from the straight line by one-quarter of an operating wavelength for communication. The dipole antenna element 101 is configured in a similar manner as that of the first embodiment, and the parasitic antenna elements 111 to 114 are configured in a similar manner as that of the parasitic antenna elements 111 and 112 of the first embodiment. The steerable antenna 200A also includes one dipole antenna element 201 and four parasitic antenna elements 211 to 214 in a similar manner as that of the steerable antenna 100A. The dipole antenna element 201 is configured in a similar manner as that of the first embodiment, and the parasitic antenna elements 211 to 214 are configured in a similar manner as that of the parasitic antenna elements 211 and 212 of the first embodiment. Also in the present embodiment, the directions and positions of the steerable antennas 100A and 200A are determined such that when both of the steerable antennas 100A and 200A operate in omnidirectional patterns, their respective radiation directions do not overlap one another for preventing the correlation between the antennas, in a similar manner as that of the steerable antennas 100 and 200 according to the first embodiment. The half-wave dipole antenna elements 101 and 201 of the steerable antennas 100A and 200A are provided in parallel with the Z-axis direction, and are located at different positions along the Z-axis direction. Accordingly, the parasitic antenna elements 111 to 114 and 211 to 214 are also provided in parallel with the Z-axis direction, and are located at different positions along the Z-axis direction.

The operation of the array antenna apparatus according to the present embodiment will be explained with reference to FIG. 7. For example, when a control voltage to the parasitic antenna elements 111 to 114 of the steerable antenna 100A is not applied, the directivity of the dipole antenna element 101 has a omnidirectional pattern in an XY plane of FIG. 7. For steering a beam in +X direction, each control terminal of the parasitic antenna elements 112 and 113 is applied with a voltage. Then, the parasitic antenna elements 112 and 113 are excited, and thus operate as reflectors for the dipole antenna element 101. Accordingly, amplitude of a radio wave is decreased in a −X direction relative to the dipole antenna element 101, and is increased in +X direction. Thus, the beam of the steerable antenna 100A is steered in +X direction. On the other hand, when only a control terminal of the parasitic antenna element 112 is applied with a voltage, the beam is steered in +X and −Y direction. Similarly, by changing a combination of parasitic antenna elements to be excited (i.e., to be operated as reflectors), the beam can be steered in any one of eight directions.

As can be seen from FIGS. 8 to 10, control lines 232*a* and 232*b* for the parasitic antenna element 212 and control lines

233*a* and 233*b* for the parasitic antenna element 213 of the steerable antenna 200A are laid adjacent to the dipole antenna element 101. As in the first embodiment, inductors 242*b* to 242*d*, 242*g* to 242*i*, 243*b* to 243*d*, and 243*g* to 243*i* are provided for preventing conductor lines routed near an antenna from being excited, and thus from affecting the antenna's directivity. A radio wave radiated from the steerable antenna 100A excites, e.g., a control line 232*ab* between the inductors 242*b* and 242*c* on the control line 232*a*, and a control line 232*ac* between the inductors 242*c* and 242*d* on the control line 232*a*. In this case, undesirable resonances in the control line 232*a* are prevented by setting the distances between the inductors 242*b*, 242*c*, and 242*d* to be such a length that substantially no resonance occurs at the operating frequency of the steerable antenna 100A. By using this configuration, it is possible to reduce the influence exerted on the directivity of the steerable antenna 100A by the control line 232*a* of the steerable antenna 200A. Also on each of other control lines, undesirable resonances in the control line are prevented by providing inductors in a similar manner as described above and as described in the first embodiment.

Each of the steerable antennas 100A and 200A is not limited to including only four parasitic antenna elements, and may include one to three parasitic antenna elements or five or more parasitic antenna elements such that the parasitic antenna elements are provided on at least one of a plurality of printed wiring boards.

As described above, the array antenna apparatus of the present embodiment is provided with pairs of PIN diodes each pair being connected to each other at their anodes, and further provided with inductors on each control line at predetermined intervals. Thus, it is possible to provide an array antenna apparatus with a circuitry for controlling directivity, capable of changing between "radiation in an omnidirectional pattern" and "radiation with a beam in a specific direction" even when operating in a centimeter-wave range of several GHz to several tens of GHz or when reducing the distances between steerable antennas, and thus suitable for a MIMO communication scheme.

Although the above-described embodiments show an example in which both of the radiating antenna element and the parasitic antenna elements are configured as dipole antenna elements, these elements may be configured as monopole antenna elements provided on a ground conductor. Moreover, each inductor is not limited to be mounted on electrode terminals of FIG. 2 by soldering etc., and may be configured as a conductor pattern on a printed wiring board.

INDUSTRIAL APPLICABILITY

A wireless communication card connection structure according to the present invention can prevent a conductor near an antenna from being excited and from affecting directivity, and accordingly, this is useful to mount multiple steerable antennas close to each other.

The invention claimed is:

1. An array antenna apparatus comprising a plurality of steerable antennas, each of the plurality of steerable antennas comprising:

an radiating antenna element;

at least one parasitic antenna element, the parasitic antenna element being located at a side of the radiating antenna element so as to be separated from the radiating antenna element in a direction by a distance, and the parasitic antenna element comprising a first conductor portion and a second conductor portion;

at least one pair of rectifier elements provided to the at least one parasitic antenna element, the pair of rectifier elements being provided between the first conductor portion and the second conductor portion, anodes of the rectifier elements being connected to each other, a cathode of a first one of the rectifier elements being connected to the first conductor portion, a cathode of a second one of the rectifier elements being connected to the second conductor portion, and the pair of rectifier elements operating the parasitic antenna element as a reflector when a bias voltage is applied thereto from a controller;

control lines connecting the rectifier elements to the controller; and at least two first inductors provided on each of the control lines at predetermined intervals, at portions of the control line being electromagnetically coupled to a steerable antenna other than the steerable antenna comprising the rectifier elements to which the control line is connected, wherein the intervals for providing the at least two first inductors is set to such a length that substantially no resonance occurs in a section of the control line between the first inductors at an operating frequency of the steerable antenna.

2. The array antenna apparatus as claimed in claim 1, wherein the intervals for providing the at least two first inductors are set to a length different from an integral multiple of one-quarter of an operating wavelength of the steerable antenna.

3. The array antenna apparatus as claimed in claim 1, wherein on each of the control lines, at least one second inductor is further provided at a portion of the control line electromagnetically coupled to the steerable antenna comprising the rectifier elements to which the control line is connected, and wherein a section of the control line between the rectifier elements and the second inductor is set to such a length that substantially no resonance occurs at an operating frequency of the steerable antenna.

4. The array antenna apparatus as claimed in claim 1, wherein the array antenna apparatus is patterned on a printed wiring board, and wherein each of the plurality of steerable antennas comprises two parasitic antenna elements such that the radiating antenna element is positioned between the parasitic antenna elements.

5. The array antenna apparatus as claimed in claim 1, wherein the array antenna apparatus is patterned on a plurality of printed wiring boards, and wherein each of the plurality of steerable antennas comprises at least one parasitic antenna element provided on at least one of the plurality of printed wiring boards.

* * * * *